US006502006B1

(12) United States Patent
Laufer et al.

(10) Patent No.: US 6,502,006 B1
(45) **Date of Patent: *Dec. 31, 2002**

(54) METHOD AND SYSTEM FOR COMPUTER AIDED EMBROIDERY

(75) Inventors: John S. Laufer, San Ramon, CA (US); Lisa A. Laufer, San Ramon, CA (US)

(73) Assignee: Buzz Tools, Inc., Danville, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/707,668

(22) Filed: Nov. 6, 2000

Related U.S. Application Data

(63) Continuation of application No. 09/358,690, filed on Jul. 21, 1999, now Pat. No. 6,167,823.

(51) Int. Cl.[7] ..... D05B 19/04; D05C 9/06

(52) U.S. Cl. ..... 700/138; 112/102.5; 112/445; 112/475.19

(58) Field of Search ..... 112/102.5, 470.01, 112/475.19, 273, 278, 445, 456, 458; 340/815.4; 700/138, 136, 137

(56) References Cited

U.S. PATENT DOCUMENTS

| | | | | |
|---|---|---|---|---|
| 4,577,574 A | | 3/1986 | Takahashi | 112/445 |
| 4,821,662 A | | 4/1989 | Pongrass et al. | 112/266.1 |
| 5,191,536 A | | 3/1993 | Komura et al. | 364/470 |
| 5,311,439 A | | 5/1994 | Hayakawa et al. | 364/470 |
| 5,320,054 A | | 6/1994 | Asano | 112/121.12 |
| 5,343,401 A | | 8/1994 | Goldberg et al. | 364/470 |
| 5,671,689 A | | 9/1997 | Clapp et al. | 112/278 |
| 5,727,485 A | | 3/1998 | Morita | 112/102.5 |
| 5,740,057 A | | 4/1998 | Futamura | 364/470.09 |
| 5,746,145 A | | 5/1998 | Cox et al. | 112/278 |
| 5,823,127 A | * | 10/1998 | Mizuno | 700/138 X |
| 5,839,380 A | | 11/1998 | Muto | 112/102.5 |
| 5,865,134 A | | 2/1999 | Okuyama et al. | 112/102.5 |
| 5,957,068 A | * | 9/1999 | Mizuno | 700/138 X |
| 5,974,992 A | | 11/1999 | Asano | 112/102.5 |
| 6,167,823 B1 | * | 1/2001 | Laufer et al. | 112/102.5 |
| 6,405,097 B1 | * | 6/2002 | Asano | 700/138 |

* cited by examiner

*Primary Examiner*—Peter Nerbun
(74) *Attorney, Agent, or Firm*—Townsend & Townsend & Crew LLP

(57) ABSTRACT

A method and system using a novel user display. The user interface device includes a display for an embroidery design. The display is coupled to a micro processing device such as a microprocessor, microcomputer, or the like. The display also has a representation a stitch on a first axis of the display. The display also shows a property of the stitch on a second axis of the display, where the second axis intersects the first axis. Other features can also be included depending upon the application.

20 Claims, 17 Drawing Sheets

METHOD AND SYSTEM FOR COMPUTER AIDED EMBROIDERY

This application is a continuation of Ser. No. 09/358,690, filed on Jul. 21, 1999. U.S. Pat. No. 6,167,823 B1.

BACKGROUND OF THE INVENTION

The present invention relates generally to embroidery applications. More particularly, the present invention provides a technique including a method, system, and device for analyzing stitch information on embroidery patterns, which are used on commercial and non-commercial sewing applications.

Many embroidery techniques are known. In the early days, people manually sewed colored threads into decorative patterns on small pieces of cloth by hand. The cloth was often held by a frame, which firmly held it in place, while skilled hands applied colored thread to the cloth to form patterns. These patterns included flowers, cartoons, and other decorative features. Multi-colored patterns often required the use of different colored threads, which had to be applied to sewing needles by hand. Since the patterns were generally sewn by hand, conventional embroidery was often time consuming and difficult to perform. Sewing machines replaced, in part, some of the conventional hand sewing techniques for embroidery. These sewing machines often provided a semi-automatic process for sewing patterns of threads onto pieces of cloth. Since sewing machines could stitch much faster than a human being, embroidery using sewing machines was more efficient. Sewing machines still required a skillful operator in order to make embroidery patterns in a high quality and efficient manner.

With the electronic age, computerized sewing machines evolved to automatically stitch patterns onto pieces of cloth to create an embroidery design. This design is derived from embroidery stitch data. In the sewing machine, embroidery stitch data translates into a series of stitches to be sewn on a work cloth to form an embroidery design. The stitch data include an ordered set of stitch coordinates or displacements and interspersed control codes. The stitch coordinates generally specify a spatial location where the embroidery needle pierces the work cloth. The control codes generally specify events. These events include thread changes used mainly to change the color of the thread; long or jump stitches: and end of the embroidery design.

The stitches are often numbered as coordinates from "1" to "n," where n is the number of stitches in the design. For example, stitch number 1 corresponds to the first needle pierce, stitch number 2 corresponds to the second needle pierce, and stitch number n corresponds to the last needle pierce. The set of embroidery stitch data for a design is commonly called a stitch-based design, and is often saved as a computer file. Embroidery stitch data are generally derived from outline data derived from a scanned or bitmap image (or drawn by a user in an embroidery drawing program). Outline data or compressed data process into embroidery stitch data using many well-known techniques. Normally the outline data represent a plurality of figures, where each figure is a separate object in the overall design. As merely an example, a flower pattern includes three elements, each representing a petal of the flower.

It is often useful to analyze a stitch-based design before sending the design to an automatic embroidery machine. Such analysis may include detecting the stitch numbers of long stitches, detecting stitch density, or detecting stitch type, for example, zigzag, fill, or satin stitch type.

Unfortunately, most conventional analysis techniques are limited. For example, most analysis tools only provide a picture of an embroidery design, which shows the design and the stitches that make up the design in a two-dimensional coordinate space. Some tools provide a textual list of stitch coordinates and control codes, but such a list is of limited value because a typical design contains many thousands of stitches. Furthermore, conventional tools cannot determine which stitches to modify in order to modify one or more figures of a stitch-based design. Although there are automatic methods that convert embroidery stitch data back to outline date, these methods are often complex and expensive; they occur for the most part automatically and out of the control of the user; and they do not always give the result the user intends. The data processing that originally creates embroidery stitch data from outline data normally processes each element in a design into one or several blocks of consecutive stitches. Thus the problem of determining which stitches to modify in order to modify one or more figures of a stitch-based design can largely be reduced to a problem of determining the starting and ending stitch number, where the starting stitch and ending stitch and the stitches in between comprise the element in question.

From the above, it is seen that improved tools for computer aided embroidery designs are desirable.

SUMMARY OF THE INVENTION

According to the present invention, a technique for analyzing stitch information on an embroidery pattern is provided. In exemplary embodiment, the present invention provides a user device and method for identifying characteristics of stitch data using a computer interface device. The present user device and method allow, for example, a user to easily identify characteristics of the embroidery data such as stitch length and stitch angle, and to use those characteristics in order to determine the stitches that comprise individual elements of a design.

In a specific embodiment, the present invention provides a graphical user interface device. The user interface device includes a display for an embroidery design, which is shown in electronic form. The display is coupled to a microprocessing device such as a microprocessor, microcomputer, or the like. The display also has a representation of a stitch (or plurality of stitches) in electronic form on a first axis of the display. The display also shows a property of the stitch in electronic form on a second axis of the display, where the second axis intersects the first axis for reference. The property of the stitch can include, among others, stitch length, stitch angle, and stitch color. Other features can also be included depending upon the application.

In an alternative aspect, the present invention provides a method for selecting an element from a plurality of elements in a complex embroidery design. The method includes providing stitch data that defines an embroidery design, where the stitch data include an element or a plurality of elements, which are separable discrete features of the complex design. The element includes a plurality of stitches in between a starting stitch number and an ending stitch number. The element is derived from or is one of a plurality of elements, which define the embroidery design. The method also includes selecting long stitches as the starting stitch number and/or the ending stitch number. The long stitches define a beginning and/or an end of the plurality of stitches defining the element.

Still further, the present invention provides a method for selecting a region in a complex embroidery design. The complex embroidery design is displayed on a user device coupled to a computing device. The method includes providing a stitches in time graph, which includes a plurality of stitches, on a user display. The plurality of stitches comprise at least a first group of stitches and a second group of stitches, where the first group of stitches is separated from the second group of stitches by a long stitch. The method also includes selecting a portion of the plurality of stitches, using a cursor applied to the portion of the plurality of stitches. The selected portion is from a group consisting of the first group of stitches, the second group of stitches, a portion of the first group of stitches a portion of the second group of stitches or any combination of the first group of stitches and the second group of stitches.

Numerous benefits are achieved by way of the present invention over conventional techniques. In a specific embodiment, the present invention provides easy to use tools to analyze a stitch-based embroidery design. Here, a goal is attained through a novel display of several charts and graphs, which we collectively call the "Stitches-in-Time" view or graph. Stitches-in-Time™ is a trademark term owned by the present Applicants. Each chart or graph has stitch number or time as one axis, and some property of each stitch as the other axis. The present embodiment charts the properties stitch length, stitch angle, and stitch color. In an alternative embodiment, the present invention provides an improved method to select one figure from a plurality of figures in a stitch-based design. Here, the present invention uses Stitches-in-Time charts and graphs, especially the stitch length chart, by enabling a user to easily select a run of consecutive stitches between any two long stitches in a stitch-based design. Because long stitches often delimit different figures in a stitch-based design, this method often can be used to select one figure from a plurality of figures in a stitch-based design. Depending upon the embodiment, one or more of these advantages may exist, without limiting the scope of the claims herein. These and other benefits will be described in more detail throughout the present specification, and more particularly below.

These and other embodiments of the present invention, as well as its advantages and features, are described in more detail in conjunction with the text below and attached Figs.

DESCRIPTION OF THE SPECIFIC EMBODIMENTS

According to the present invention, a technique for analyzing stitch information on an embroidery pattern is provided. In exemplary embodiment, the present invention provides a user device and method for identifying characteristics of stitch data using a computer interface device. The present user device and method allow a user to easily identify characteristics of the embroidery data such as stitch length, stitch angle, and others. Details of the present invention are described by way of the Figs. below.

Figure 1:
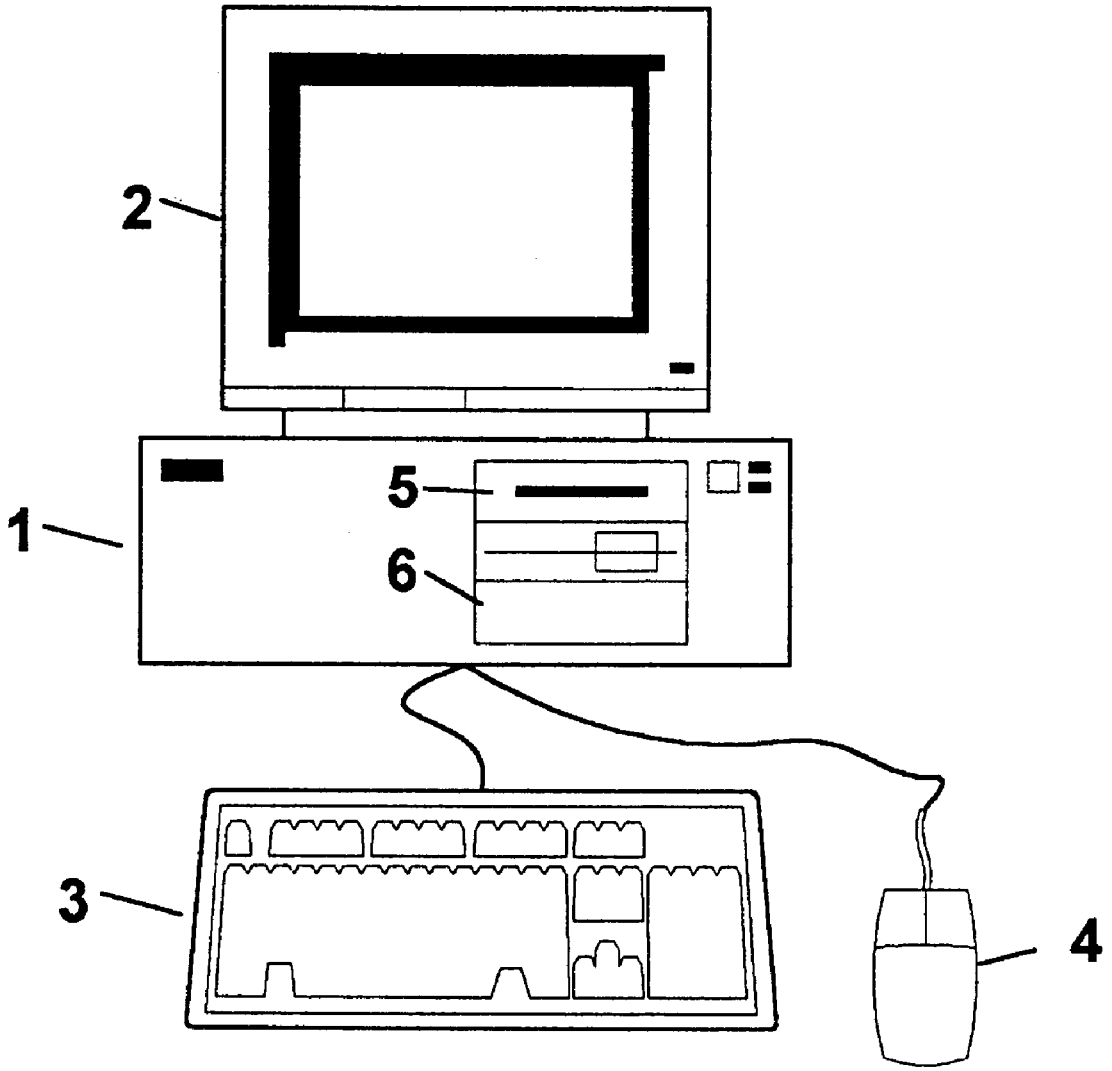
FIG. 1 is a simplified diagram of system hardware for an embroidery data processing device according to embodiments of the present invention.

FIG. 1 is a simplified schematic view diagram of an embroidery data processing apparatus that is used as a stitch editor. This diagram is merely an example which should not limit the scope of the claims herein. One of ordinary skill in the art would recognize many other variations, modifications and alternatives. The embroidery data processing apparatus includes a display 2 for displaying pictures, charts and graphs. The display can include a cathode ray tube ("CRT"), flat panel display, or the like. The display is coupled to a microcontroller unit 1. The microcontroller unit can be a microprocessor-based computer or personal computer such as an Intel based design or the like. The microcontroller unit includes interfaces devices such as a keyboard 3 and a mouse 4 for collecting input from a user. The microcontroller also has a memory storage unit, such as a floppy disk device 5 and hard disk device 6 for storing embroiderv data.

The data processing apparatus can be coupled to a sewing machine (or embroidering machine). The sewing machine includes a variety of features such as a frame that can be mounted on a stage. The stage can be capable of moving the frame in two or three dimensions. These dimensions include an x-direction, a y-direction, and a z-direction. A sewing needle and a hook mechanism are also included. A piece of cloth is fixed in the frame, which moves the cloth in a pattern to form the embroidery design on it. The sewing machine also has a variety of electronic elements, which are used to oversee operation of the hardware features. These elements include, among others, a microcomputer, which controls the stage and needle. The microprocessor also retrieves information from memory, which includes the embroidery data, and converts the data in to a sequence of stitches for providing the design onto the cloth for embroidery purposes. These and other elements are included in the sewing machine apparatus.

Figure 2:
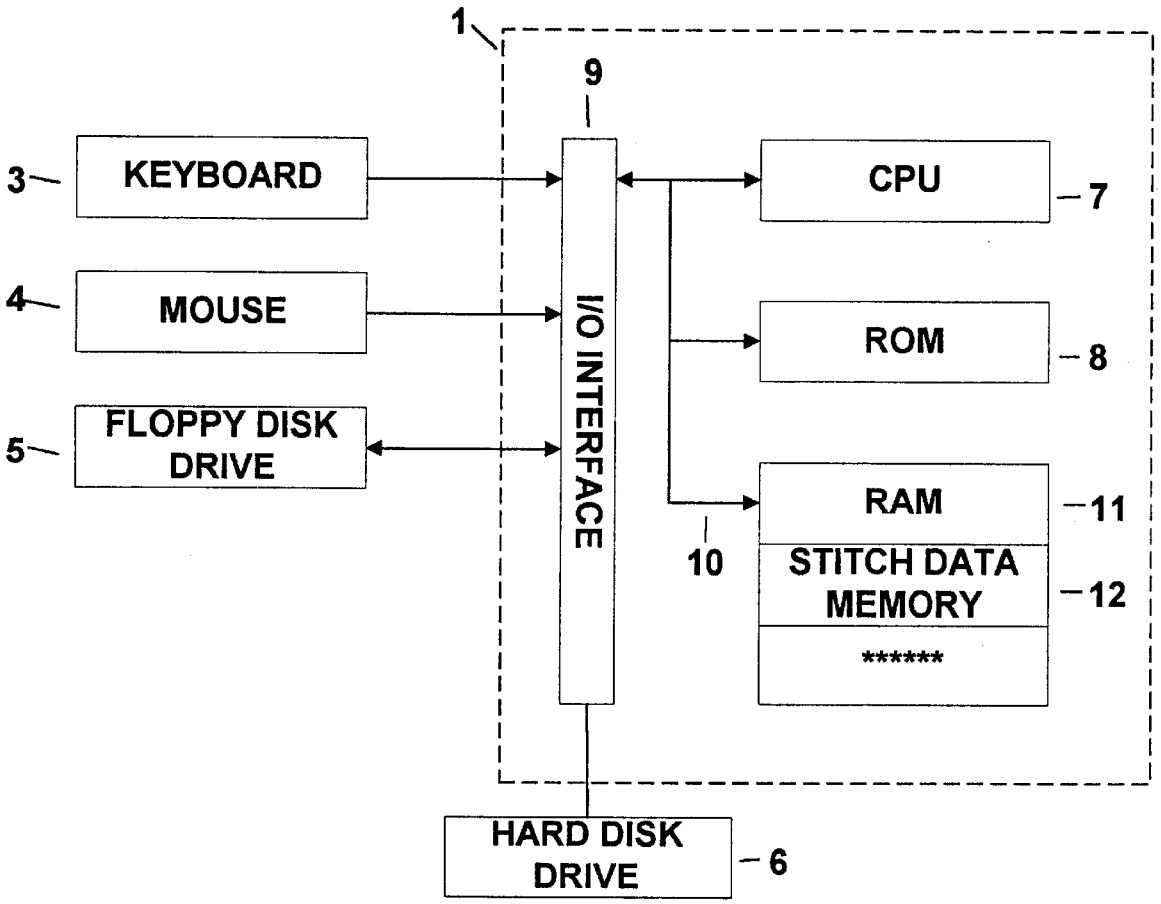
FIG. 2 is a simplified block diagram illustrating a control system of an embroidery data processing device.

FIG. 2 is a block diagram illustrating a control system of the embroidery data processing apparatus, which can be included in the above systems. The control unit 1 includes the CPU 7 which is connected with an input/output (I/O) interface 9 through a bus 10 having a data bus and the like. The controlling unit further includes a ROM (Read Only memory) 8, and a RAM (Random Access Memory) 11. In the ROM 8 and/or the RAM 11, control programs to be executed by the CPU 7 to create the embroidery data are stored. The RAM 11 includes a stitch data memory 12 that stores the embroidery stitch data in a common format. The ROM can also be replaced by a variety of other memory devices such as a flash memory device and others. Details of methods according to embodiments of the present invention are provided below.

Figure 3:
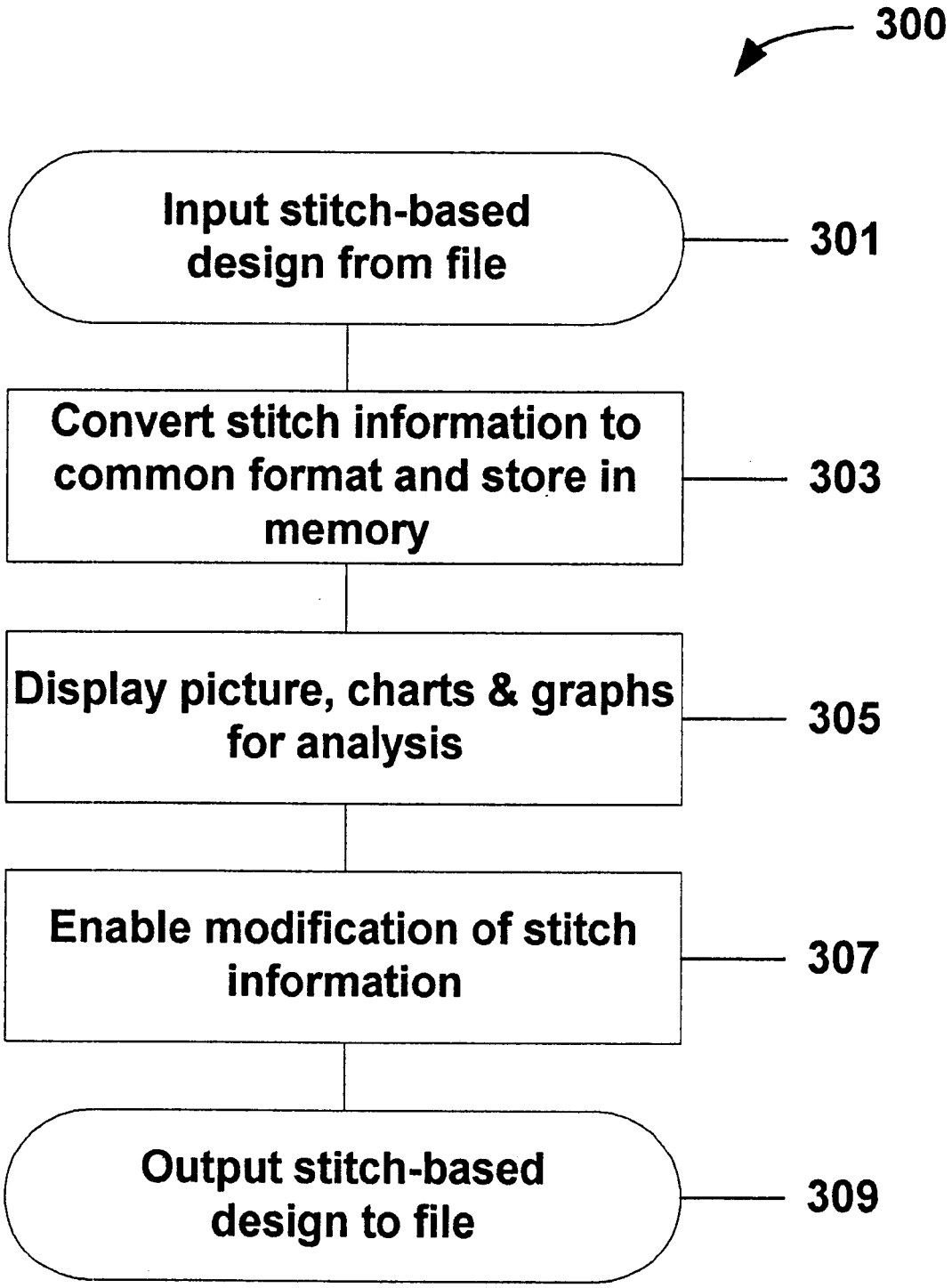
FIG. 3 is a simplified flow diagram of the embroidery data processing method according to the present invention.

FIG. 3 is a simplified flowchart 300 illustrating a process for analyzing and modifying embroidery stitch data according to an embodiment of the present invention. This chart is merely an example, which should not limit the scope of the claims herein. One of ordinary skill in the art would recognize many other variations, alternatives, and modifications. The method provides a stitch-based design. In particular, the embroidery stitch-based design is read (step 301) from a file located on the hard drive or a floppy disk. Next, the method converts (step 303) the stitch-based design into a common memory format. The formatted design is stored in the stitch data memory. A picture of the stitches in 2-dimensional space is presented on a display (step 305) to a user, as are the charts and graphs collectively called the "Stitches-in-time" graph and described below. The user analyzes the stitch data by means of the picture, charts and graphs. Based upon the analysis, the method then modifies (step 307) the stitch data by use of the keyboard and mouse. Depending upon the embodiment, the modification can vary from design to design. Next, the method saves (step 309) the modified design back to the same file or a different file.

In a specific embodiment, the input stitch-based embroidery design is originally produced by another embroidery creating data processing system. It may have been obtained from an internet or the Internet or various other means. The output stitch-based embroidery design is sent to an automatic sewing machine by another embroidery data processing system. Alternate configurations of the invention may involve reading or writing the stitch data to a memory card or directly to an automatic sewing machine.

In a specific embodiment, the present invention provides a novel user interface with several charts and graphs of the design, collectively called the Stitches-in-Time graph, which can be used to analyze a stitch-based design. Each chart or graph has a stitch number or time as one axis, and some property of each stitch as the other axis. In a preferred embodiment, stitch number stretches along the horizontal or x-axis, and the stitch property stretches along the vertical or y-axis. The domain of stitches displayed along the x-axis may include all of the stitches in the design, that is, stitch numbers 1 to n, where n is the number of stitches in the design, or it may include a consecutive subset of the stitches. Either way, in the present embodiment the length of the x-axis display is divided into equal divisions by the number of stitches in the domain. In an alternate configuration, the axis can represent time instead of stitch number, where the distance between stitch numbers is proportional to the amount of time taken to sew the stitch, which varies depending on the length of the stitch and the angle of the stitch.

Figure 4:
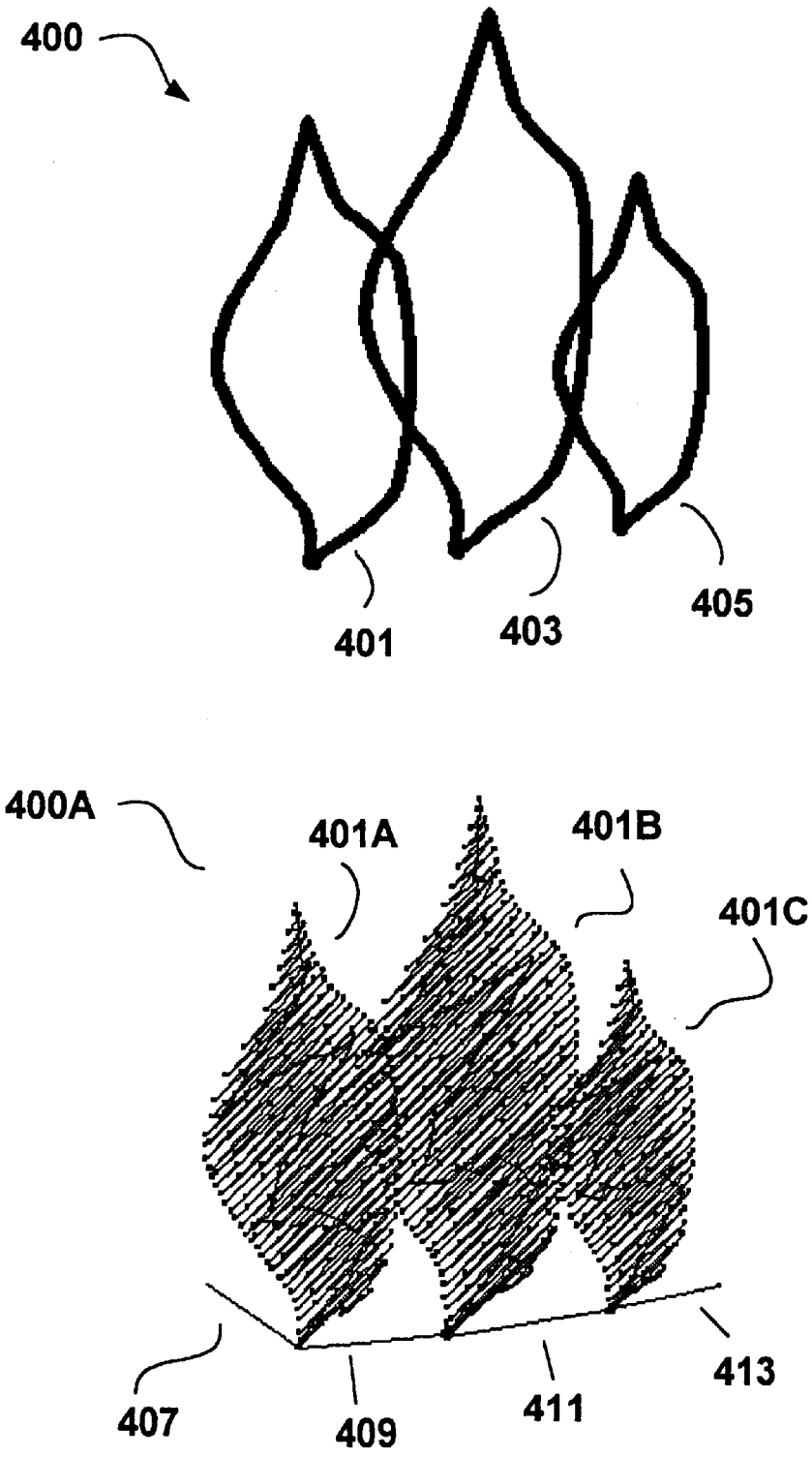
FIG. 4 is a simplified illustration of creating stitch data from outline data according to an embodiment of the present invention.

In order to better understand the present invention, it may assist the reader to review the simplified diagram 400 of an embroidery pattern of FIG. 4. This diagram is merely an example, which should not limit the scope of the claims herein. One of ordinary skill in the art would recognize many other variations, modifications, and alternatives. The embroidery pattern 400 is a flower, which has a plurality of leaves 401, 403, and 405. Each of these leaves overlaps, to an extent, with another leaf, as shown. Leaf 401 overlaps with leaf 403, which overlaps with leaves 405 and 401. The pattern 400A represents a stitched pattern, including the plurality of leaves. The stitched pattern includes leaves 401A, 401B, and 401C. As shown, the stitched pattern includes a first stitch 407 for leaf 401A and a last stitch 409 for leaf 401A. The stitched pattern includes a first stitch 409 for leaf 401B and a last stitch 411 for leaf 401B. The stitched pattern includes a first stitch 411 for leaf 401C and a last stitch 413 for leaf 401C. Each of these leaves represents a figure or element of the embroidery design. Depending upon the application, each of these leaves may have similar coloration or different coloration. In embodiments with similar coloration, it is often difficult to see and visualize the first and last stitches. especially between adjacent leaves, which overlap with each other. (For illustrative purposes, the first and last stitches are apparent in FIG. 4. Usually, however, the first and last stitches will be obscured by other overlapping stitches.) The present diagram can be included or displayed on a user display. The present invention includes many other user displays such as those noted below. These displays are called "stitches in space" graphs.

Figure 5:
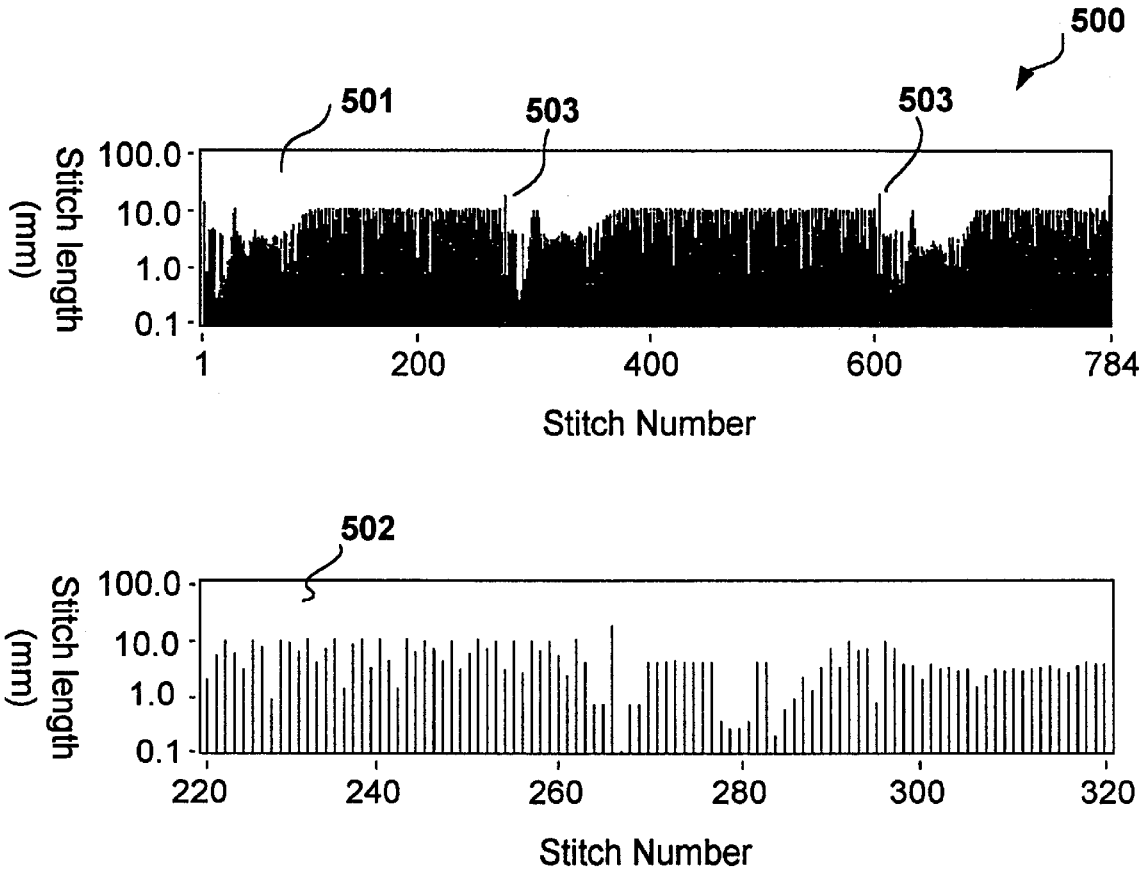
FIG. 5 is a simplified illustration of a stitch length chart according to an embodiment of the present invention.

In a specific embodiment, the present embodiment includes one or more of the following charts and graphs:

Stitch length chart: A bar chart in which each stitch is drawn as a vertical bar, as shown in a user display of FIG. 5. This display is merely an example, which should not limit the scope of the claims herein. One of ordinary skill in the art would recognize many other variations, modifications, and alternatives. As shown, stitch length is plotted against stitch number, where the vertical axis represents the stitch length and the horizontal axis represents the stitch number. The height of each bar of the chart is proportional to the log of the length of the stitch. Alternatively, the height of each bar is proportional to the length of the stitch. In preferred embodiments, the color (e.g., red, green) of each bar matches the color of the stitch that is used for the embroidery pattern.

Depending on the number of stitches shown in the chart, the bars of the chart may overlap, giving the chart an appearance of a histogram (501). When fewer stitches are shown, the individual bars of the chart are seen (502), where each bar has a spacing in between. These stitch length charts allow one to visualize the design in a powerful and unique way, mainly because long stitches 503 stand out in the graph as vertical spikes. It is useful to be able to visualize long stitches, since these often delimit runs of stitches that corresponds to different figures in a design. For example, the long stitches shown in FIG. 5 delimit the three different petals of the flower shown in FIG. 4.

The stitch length graph can also be used to judge the stitch density, since shorter stitches result in a higher stitch density. The stitch length graph can also be used to distinguish some stitch types from one another. For example, satin stitches constitute a run of longer stitches; fill or running stitches constitute a run of relatively shorter stitches.

Depending upon the embodiment, one or more stitch length graphs can be used on the user interface device. In some embodiments, either scale (i.e., stitch length, stitch number) may be expanded or contracted. Additionally, the present graph can be displayed with any of the graphs or figures herein, as well as others. These and other variations, alternatives, and modifications can be recognized by anyone of ordinary skill in the art.

Figure 6:
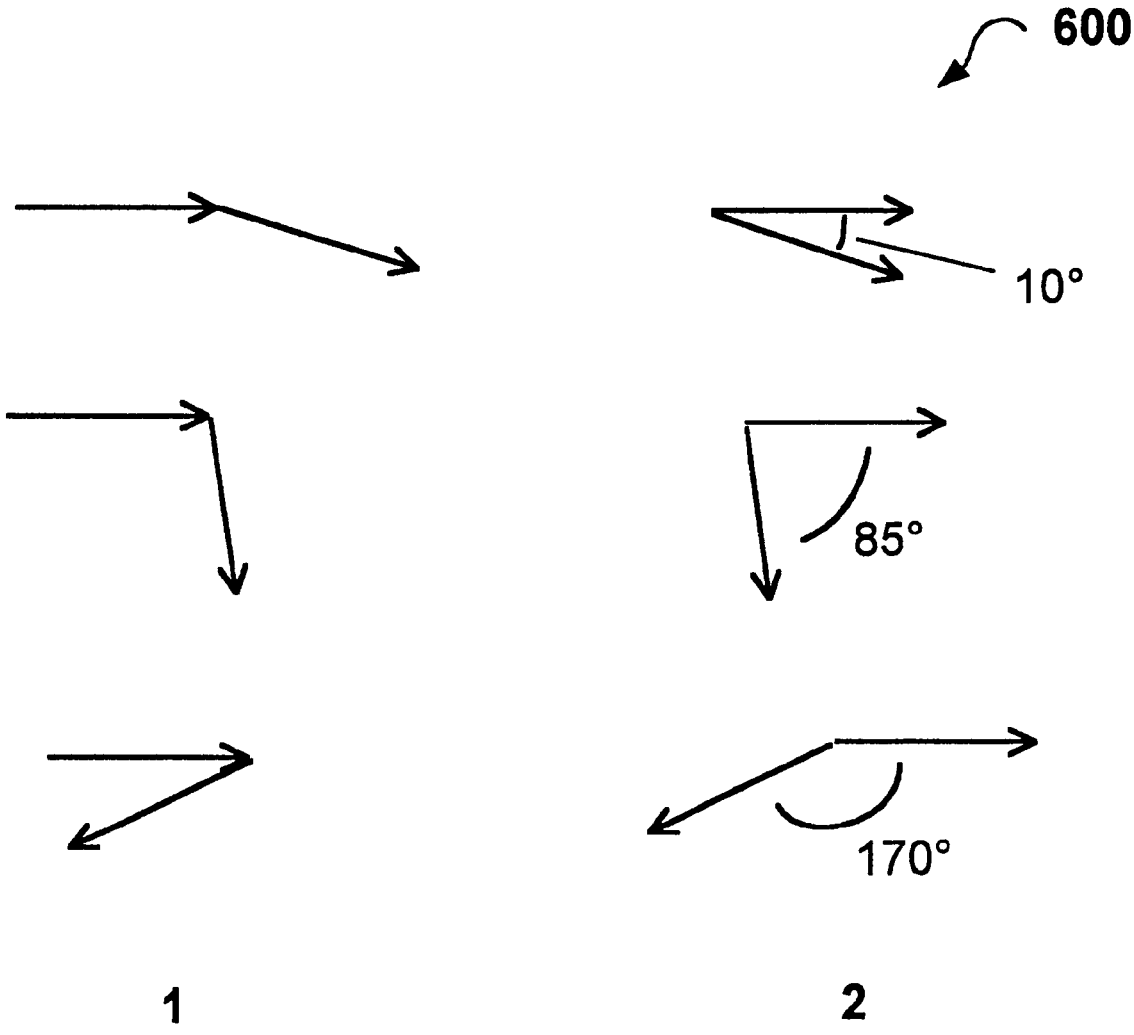
FIG. 6 is a simplified illustration of stitch angle calculation according to an embodiment of the present invention.

Stitch angle graph: A line graph that is a plot of an angle between each stitch and a subsequent (or previous) stitch. The angle is computed by treating each stitch as a vector stretching from the stitch coordinate to the coordinate of the next stitch. The origins of two consecutive stitch vectors are aligned, and the angle between the two vectors is computed. This method is illustrated in, for example, FIG. 6 for three different stitches 600. The stitches are shown before (1) and after (2) aligning the origins. Any angle greater than 180 degrees is computed as the complement to the angle by subtracting the angle from 360 degrees. Thus the range of angles is from 0 degrees to 180 degrees.

Figure 7:
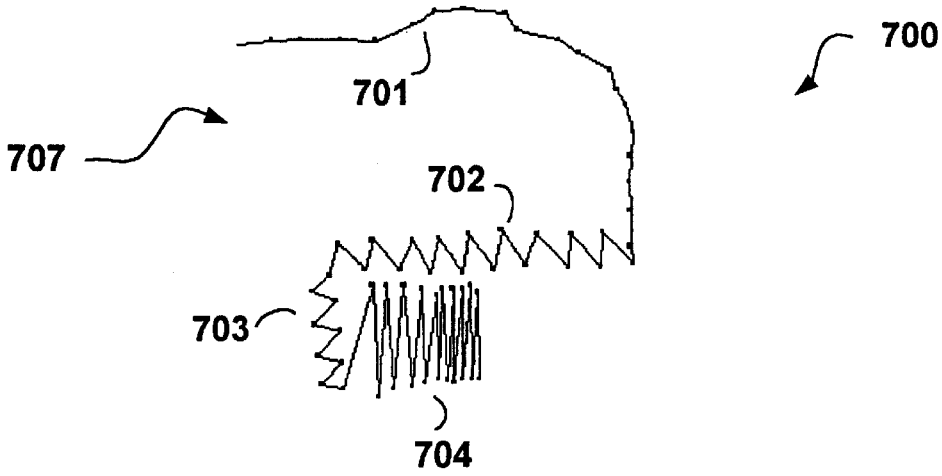
FIG. 7 is a simplified illustration of a stitch angle graph according to an embodiment of the present invention.
Figure 7:
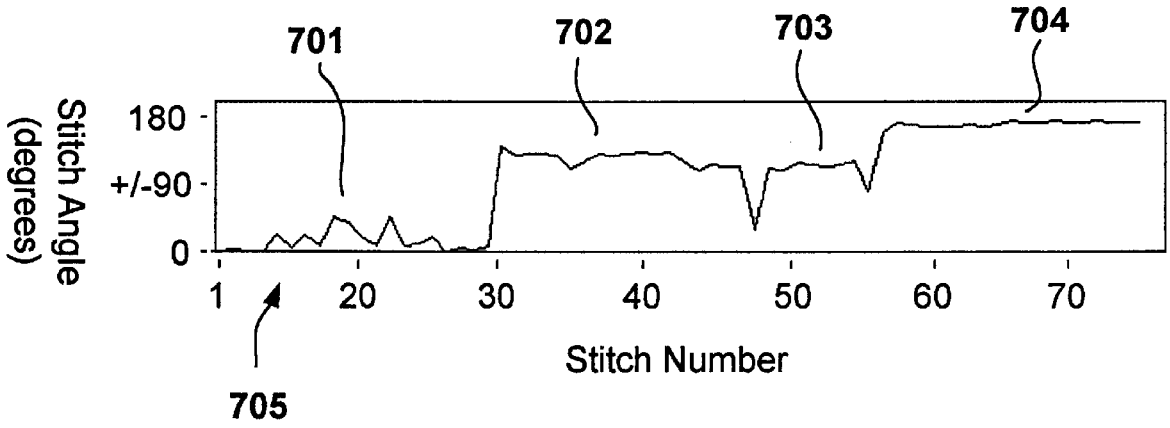

Each different stitch type has a characteristic appearance in the stitch angle graph. A few of these different stitch types are shown by in FIG. 7. As shown, the graph 700 includes two portions, a lower graph 705 and an upper graph 707. The lower graph 705 has a vertical axis, which represents stitch angle, and a horizontal axis, which represents stitch number. The upper graph 707 illustrates the stitches on an embroidery pattern. As merely an example, a running stitch is composed mainly of stitches that run in the same direction, hence in the stitch angle graph a block of running stitches is displayed as a line that hugs the bottom of the graph 701. A zigzag stitch goes back and forth at an angle around 90 degrees. Thus in the stitch angle graph a block of zigzag stitches is displayed as a line 702, 703 running through the center of the graph. A satin stitch region is composed of long stitches that go back and forth. Each turn of the stitch approaches 180 degrees, hence in the stitch angle graph a block of satin stitches is displayed as a line running near the top of the graph 704. A fill stitch region is composed of several stitches that run in the same direction followed by a stitch that makes a U-turn, hence the fill stitch has a more complex appearance (not shown).

The stitch angle graph can be used in conjunction with the stitch length graphs to better characterize the stitch type. Depending upon the embodiment, one or more stitch angle graphs can be used on the user interface device. In some embodiments, either scale (i.e., stitch angle, stitch number) may be expanded or contracted. Additionally, the present graph can be displayed with any of the graphs or figures herein, as well as others. These and other variations, alternatives, and modifications can be recognized by anyone of ordinary skill in the art.

Figure 8:
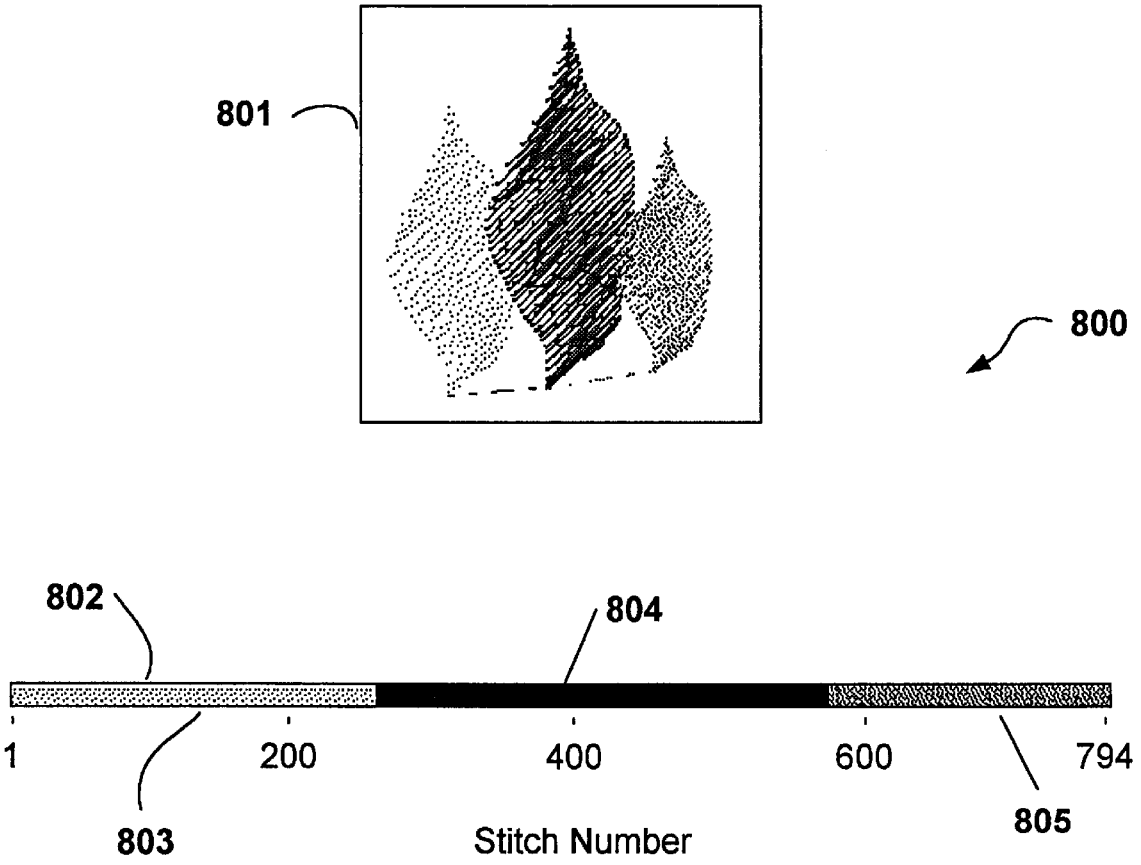
FIG. 8 is a simplified illustration of a stitch color chart according to an embodiment of the present invention.

Stitch color chart: A component bar chart that shows the color of each stitch. Each run of consecutive stitches in one color is shown as a rectangle (or other shape) of the color. The length of the rectangle is proportional to the number of stitches in the run of stitches. FIG. 8 illustrates a design 800 with three different colors 801 along with the color change chart 802 for the same design. As shown, the color change chart includes a first color 803, a second color 804, and a third color 805.

The color change chart can be used in conjunction with any of the other graphs to better characterize the stitch type. Depending upon the embodiment, one or more color change charts can be used on the user interface device. In some embodiments, either scale (i.e., color change, stretch number) may be expanded or contracted. In a specific embodiment, the color chart is a component chart of stitch color plotted as a function of stitch number or time, where the component chart comprises a plurality of spatial features, e.g., rectangular region. Each of the spatial features represents a color, and each of the spatial features has an area that is proportional to a number of stitches for the color. Additionally, the present chart or graph can be displayed with any of the graphs or figures herein as well as others. These and other variations, alternatives, and modifications can be recognized by any one of ordinary skill in the art.

Figure 9:
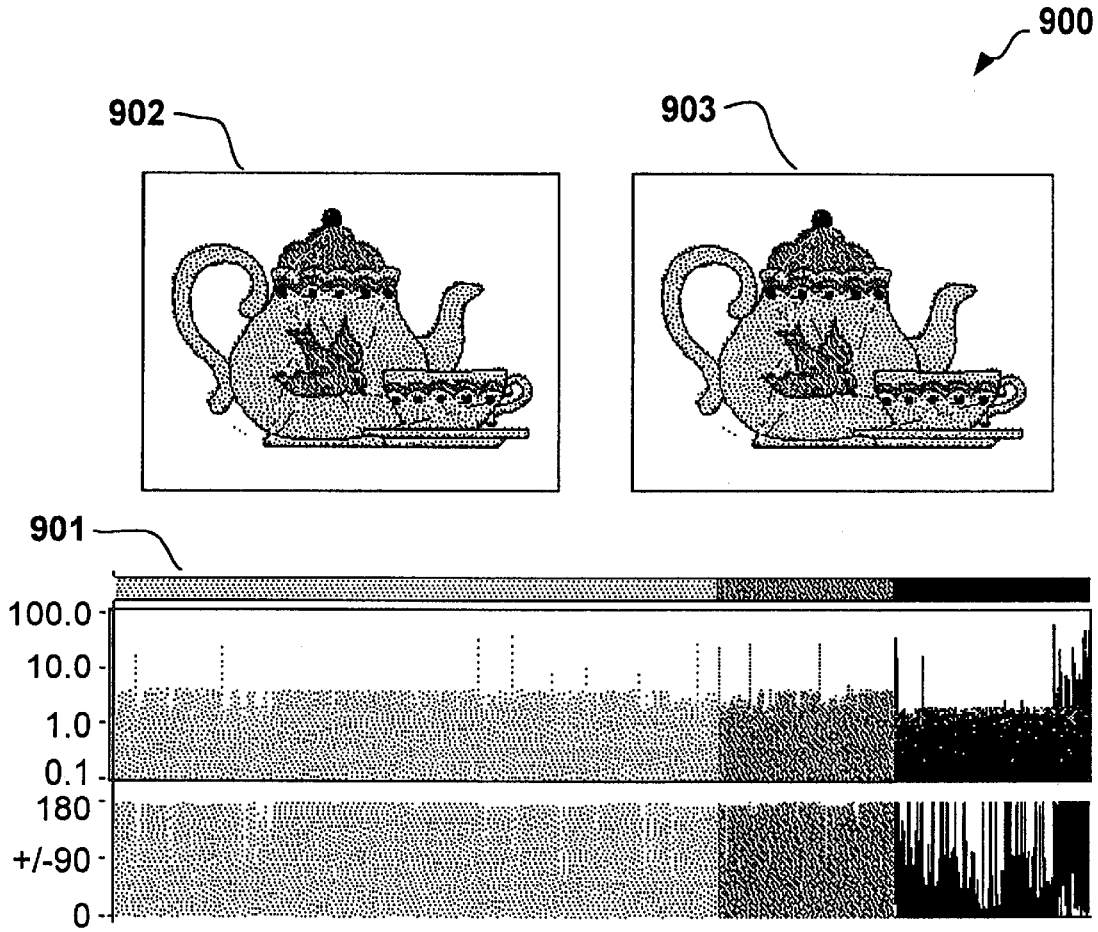
FIG. 9 is a simplified illustration of an analysis system according to an embodiment of the present invention.

In a preferred embodiment, the present invention (see FIG. 9) displays each of the Stitches-in-time graphs together 901 along with one picture of the design 902 that serves as a work picture and another picture of the design 903 that serves as a reference picture. As shown, the graphs include a stitch length graph, a stitch angle graph, and a stitch color chart, which are each displayed in alignment with each other relative to a scale of stitch number.

Figure 10:
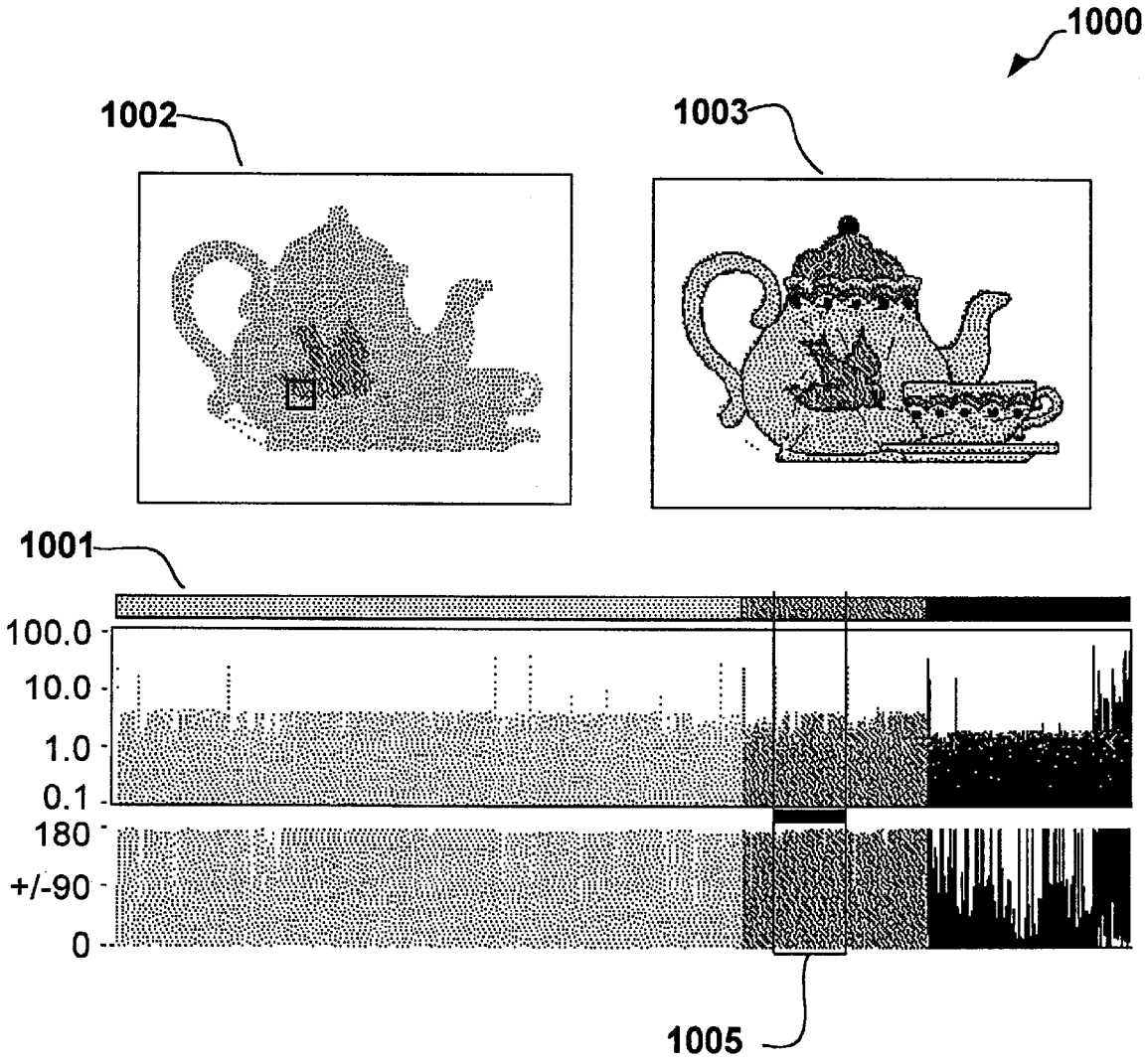
FIG. 10 shows a feedback of a selection of a run of consecutive stitches according to an embodiment of the present invention.

In an alternative embodiment, the present invention provides charts and graphs in any of the above aspects to aid the user in choosing a starting and ending stitch number which will select a desired figure or part of a design. Pressing and dragging a mouse horizontally in any of the Stitches-in-time graphs specifies a starting stitch and ending stitch, where the starting stitch and ending stitch and all of the stitches in between constitute a selection. The selection can be passed to other algorithms that manipulate the selection. In the preferred embodiment, feedback of the chosen selection is given in both in the Stitches-in-time graphs and in a picture of the design, as shown in the simplified diagram of FIG. 10. The Stitches-in-time graphs 1000 delimit the selection with vertical lines 1005. The picture 1002 shows the selection in color, whereas the rest of the stitches are displayed in gray. The picture 1003 shows all of the stitches in color for reference. In the present embodiment, the mouse cursor is translated to a stitch number by taking the x position of the mouse cursor and computing the number of the stitch which is displayed closest to the mouse cursor. One stitch number is computed when the mouse button is pressed, and a second stitch number is computed when the mouse button is released. Of the two stitch numbers, the smallest is taken as the starting stitch number and the largest is taken as the ending stitch number.

A method according to the present invention for identifying a starting stitch number and an ending stitch number in a region of an embroidery design may be briefly outlined as follows:

(1) Provide a user interface device (on a computer) including stitches in time graph for an embroidery design according to the present invention;

(2) Display design in stitches in time graph, and optionally in stitches in space graph;

(3) Based upon the stitches in time, begin a selection process of a region of stitches using a mouse or other user device, which positions a cursor;

(4) Position the mouse cursor in a first location (i.e., x and y directions) of the stitches in time region and depress the mouse button;

(5) Determine the x position of the mouse cursor along stitches in time graph at the first location;

(6) Compute starting stitch number from the x-position;

(7) Highlight the starting stitch in the Stitches in time graph;

(8) Drag the mouse cursor to a second location in the region in the stitches in time;

(9) While performing step (8), repeat steps (5) to (7) above as the mouse cursor is being dragged to the second location;

(10) Release the mouse button at the second location;

(11) Repeat steps (5) to (7), using the position of the mouse cursor in step (10), to compute the ending stitch number and highlight the ending stitch in the Stitches in time graph;

(12) Highlight the stitches between the starting stitch number and the ending stitch number in the Stitches in space view and the Stitches in time graphs to select an element or a portion of an element or any combination of these in the design (where the highlight of the stitches in the stitches in space may occur simultaneously as the highlight of the stitches in the stitches in time graph);

(13) Perform a manipulation such as color change, movement, geometrical transformation (e.g., translational movement, rotational movement, scaling, stretching, skewing, flipping, or any combination of these), deletion, insertion into another design, or stitching order change for the selected element;

(14) Display manipulated element with modified design in stitches in space and stitches in time graph; and

(15) Perform other steps, if desired.

Figure 11:
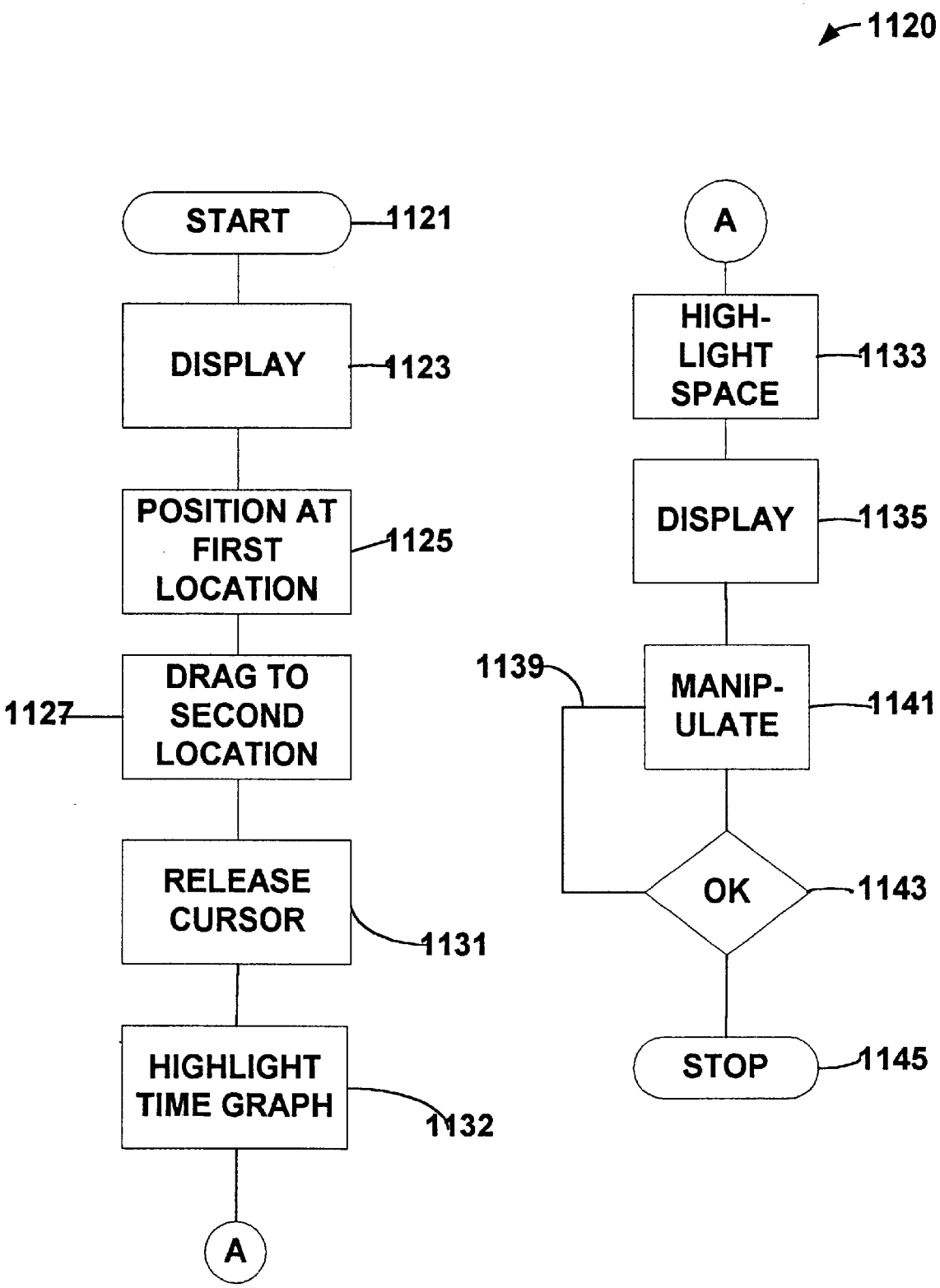
FIGS. 11 and 11A to 11F are simplified diagrams of methods and user devices according to embodiments of the present invention

The above sequence of steps is merely an illustration. The present sequence provides an easy way to manipulate an element or portion of an element in a design using a stitches in time and stitches in space graphs. The manipulation can occur in color, shape, location, and any combination of these. These and other details will be described in more detail with reference to FIG. 11, for example.

Figure 11A:
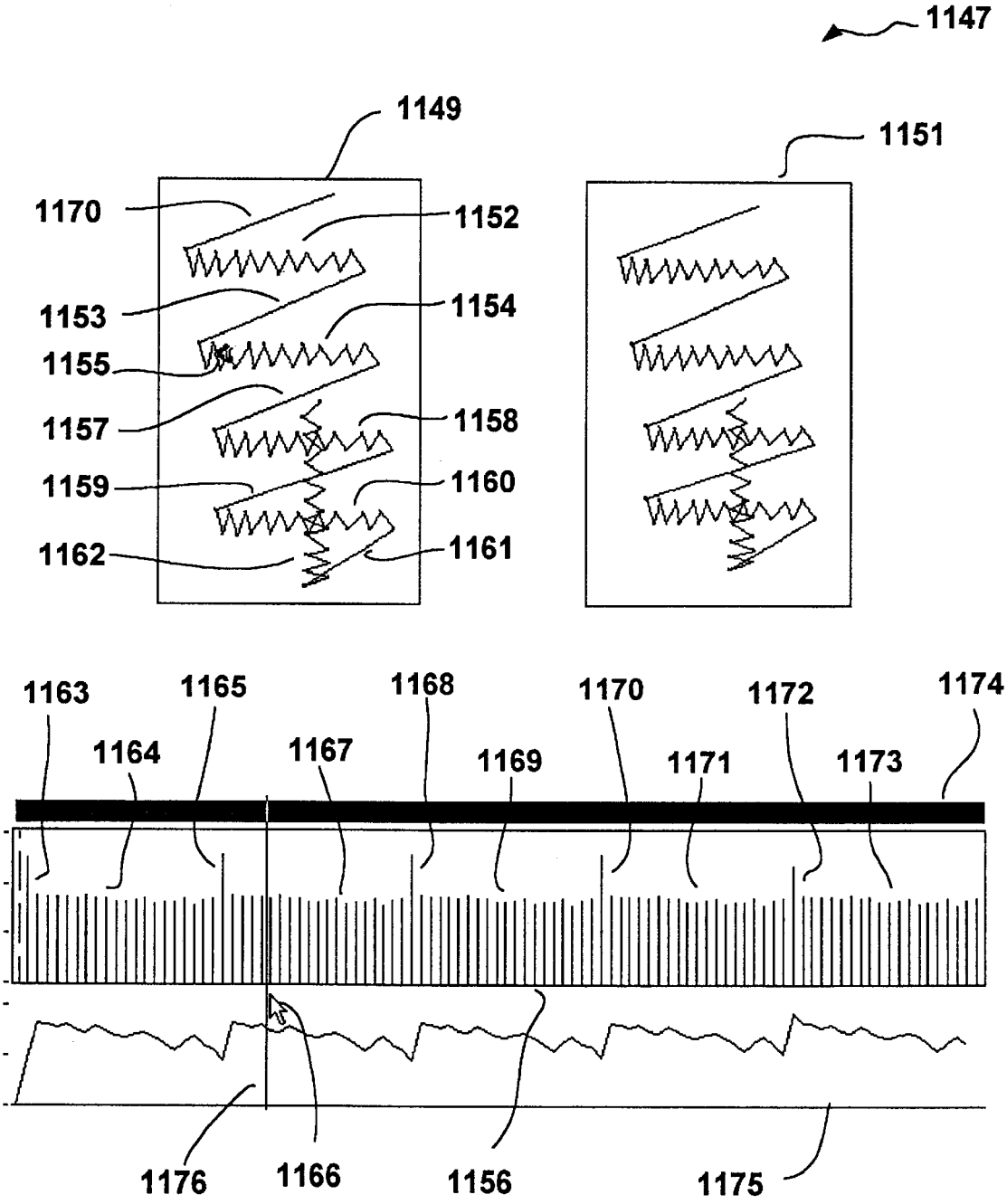

According to the present invention, the present method 1120 begins at start, step 1121. The method provides a program, which has a user interface device according to the present invention. The user interface device includes a stitches in time and a stitches in space design, such as those noted, but can be others. The present method displays the design in the stitches in time graph and, optionally displays the design in the stitches in space graph, step 1123. As merely an example, FIG. 11A is a simplified user device 1147, which includes a stitches in space graph 1149 that highlights a selection of stitches by showing highlighted stitches in color and un-highlighted stitches in gray, and a reference stitches in space graph 1151 that displays all of the stitches in color. This display is merely an example, which should not limit the scope of the claims herein. One of ordinary skill in the art would recognize many other variations, modifications, and alternatives. The display has a a stitches in time graph, which includes a stitch length graph 1156, a stitch color graph 1174, a stitch angle graph 1175, and others. The stitches in the stitches in space graph correspond to the stitches in the stitches in time graph. For example, long stitch 1163 in the stitch length graph corresponds to an end of stitches 1170 in the stitches in space graph, and stitches 1164 in the stitch length graph correspond to stitches 1152 in the stitches in space graph. Long stitch 1165 corresponds to long stitch 1153. Stitches 1167 correspond to stitches 1154. Long stitch 1168 corresponds to long stitch 1157. Stitches 1169 correspond to stitches 1158. Long stitch 1170 corresponds to long stitch 1159. Stitches 1171 correspond to stitches 1160. Long stitch 1172 corresponds to long stitch 1161. Stitches 1173 correspond to stitches 1162, and so on.

Based upon the stitches in time, begin a selection process of a region of stitches using a mouse or other user device, which positions a cursor (or other user identifiable indication). The user interface device can also be a keyboard, a touch screen, a microphone, or other user interface means. Referring to FIG. 11A, the mouse cursor 1166 is positioned in a first location (i.e., x and y directions) of the stitches in time region (step 1125). Here, the method determines the x position of the mouse cursor along stitches in time graph at the first location. In a specific embodiment, the method computes a starting stitch number from the x-position in relation to the stitch number axis of the Stitches in time graph. The starting stitch is highlighted in the Stitches in time graph with a vertical line 1176, which corresponds to an indication 1155 in the stitches in space graph, which may be displayed simultaneously.

Figure 11B:
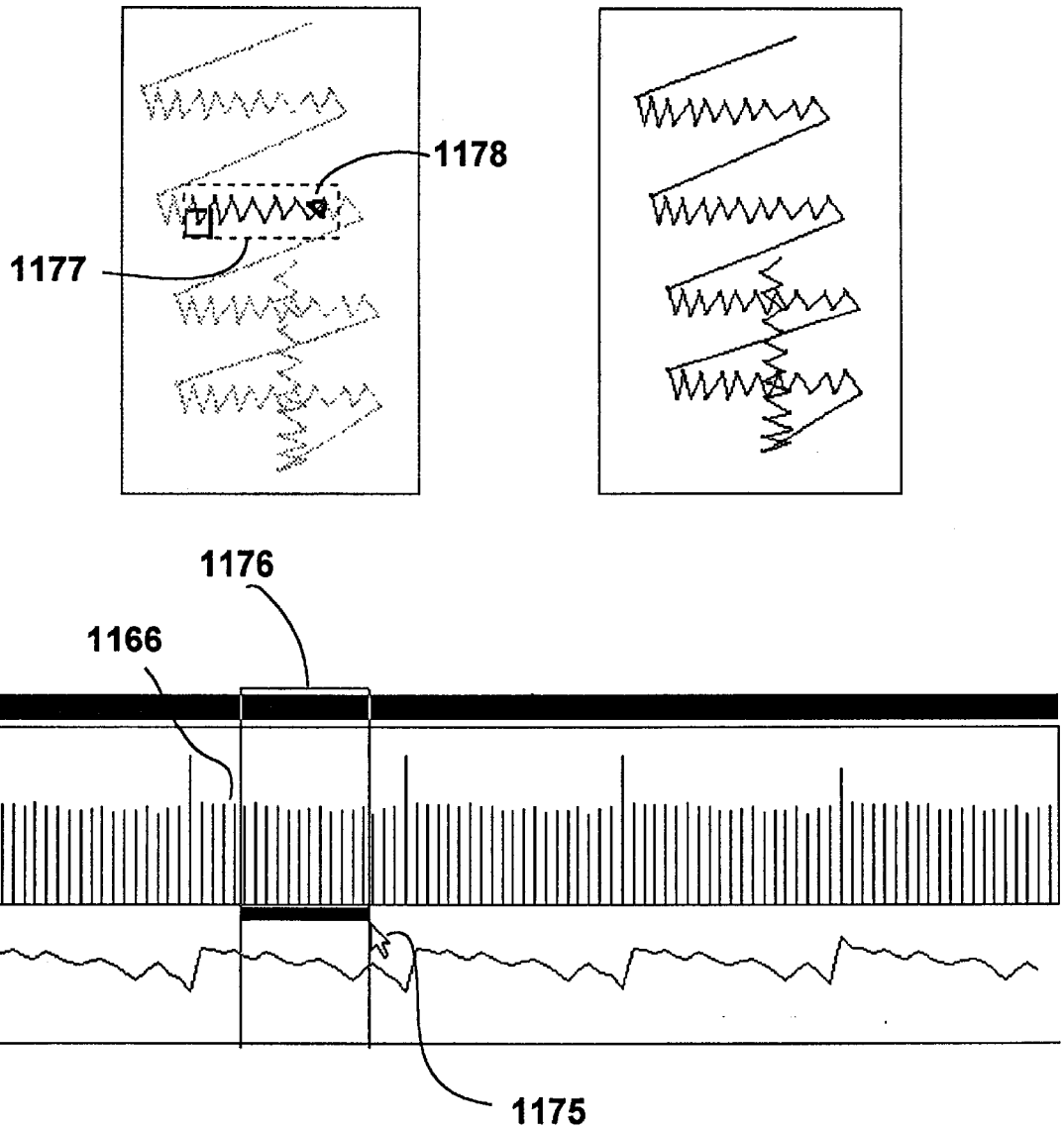

Next, the method drags (step 1127) the mouse cursor to a second location in the stitches in time graph. The mouse cursor is then released at the second location. Referring to FIG. 11B, the x-position of the mouse cursor 1175 is used to compute an ending stitch number. Each of the stitches between the starting stitch and the ending stitch is highlighted in the stitch in time graph 1176. The corresponding stitches are also highlighted in the Stitches in space graph 1177. Here, the method highlights the stitches between the starting stitch number and the ending stitch number in both the stitches in time graph (step 1132) and the stitches in space graph (step 1133) to select an element or a portion of an element or any combination of these in the design (where the highlight of the stitches in the stitches in space may occur simultaneously as the highlight of the stitches in the stitches in time graph). Highlighting occurs on the display or user interface (step 1135), as shown. In step 1141, the present method performs a manipulation on the selected region. The manipulation changes a spatial or color characteristic of the selected or highlighted region. The manipulation can include a color change, a movement (from one location to another), a geometrical transformation, and other change such as texture change of the selected stitches. The transformation can include, among others, translational movement, rotational movement, scaling, stretching, skewing, flipping, or any combination of these for the selected element. Once the desired manipulation has been performed, the method goes to step 1145, which is stop. Alternatively, the method returns via branch 1139 from step 1143 to step 1141 to manipulate the selected stitches again, until a desired outcome occurs. Other steps can also be performed, depending upon the application.

Although the above invention has been described using a specific sequence of steps. It would be recognized that other variations can exist. For example, the sequence of steps can be changed in order. Additionally, a step in the sequence of steps can be removed. Alternatively, steps in the sequence can be combined. Furthermore, an additional step or steps can be inserted. Any one of the steps herein can be inserted as well as removed, depending upon the application. These and other combinations will be apparent to those of ordinary skill in the art.

An alternative method according to the present invention for identifying a starting stitch number and an ending stitch number in a region of a design may be briefly outlined as follows:

(1) Select a region of stitches by a user device (on a computer) in a stitch length graph for an embroidery design according to the present invention;

(2) Position the mouse cursor in a first location (i.e., x and y directions) of the stitches length graph and depress the mouse button;

(3) Determine an x position of mouse cursor along the stitch number axis of the graph, which can run along a horizontal axis;

(4) Compute mouse cursor stitch number from the x-position;

(5) Determine y position of mouse cursor along stitch length axis of the graph, which is normal to the stitch number axis;

(6) Compute mouse cursor stitch length from the y position of the mouse cursor;

(7) Search for higher number stitches and lower number stitches to identify a stitch on each side having a higher y height than the y position of the mouse cursor (and therefore a longer stitch length than the mouse cursor stitch length), where the stitch on the higher number side is defined as "A" and the stitch on the lower number side is defined as "C";

(8) Define the number of stitches between the mouse cursor and the stitch having a higher y position on the higher number side as "B";

(9) Define the number of stitches between the mouse cursor and the stitches having a higher y position on the lower number side as "D";

(10) If B is greater than D then use A as the starting stitch, otherwise use C as the starting stitch;

(11) Highlight the starting stitch based upon step (10);

(12) Drag mouse to second location;

(13) Repeat steps (3) to (11) above as the mouse is being dragged to the second location;

(14) Release the mouse button when the mouse cursor is at the second location;

(15) Repeat steps (3) to (11) to highlight the ending stitch;

(16) Highlight the stitches between the starting stitch number and the ending stitch number in the stitch length graph and/or the stitches in space graph to define an element or a portion of an element or portions of more than one element in the design;

(17) Perform a manipulation (e.g., color change, movement, geometrical transformation) for the selected element or the portion of the element in the design;

(18) Display manipulated element with modified design in space in time graph; and

(19) Perform other steps, if desired.

The above sequence of steps is merely an illustration. The present method allows for a user to select a single element, without interference of other elements. These and other details will be described in more detail with reference to FIGS. 11C to 11F, for example.

Figure 11C:
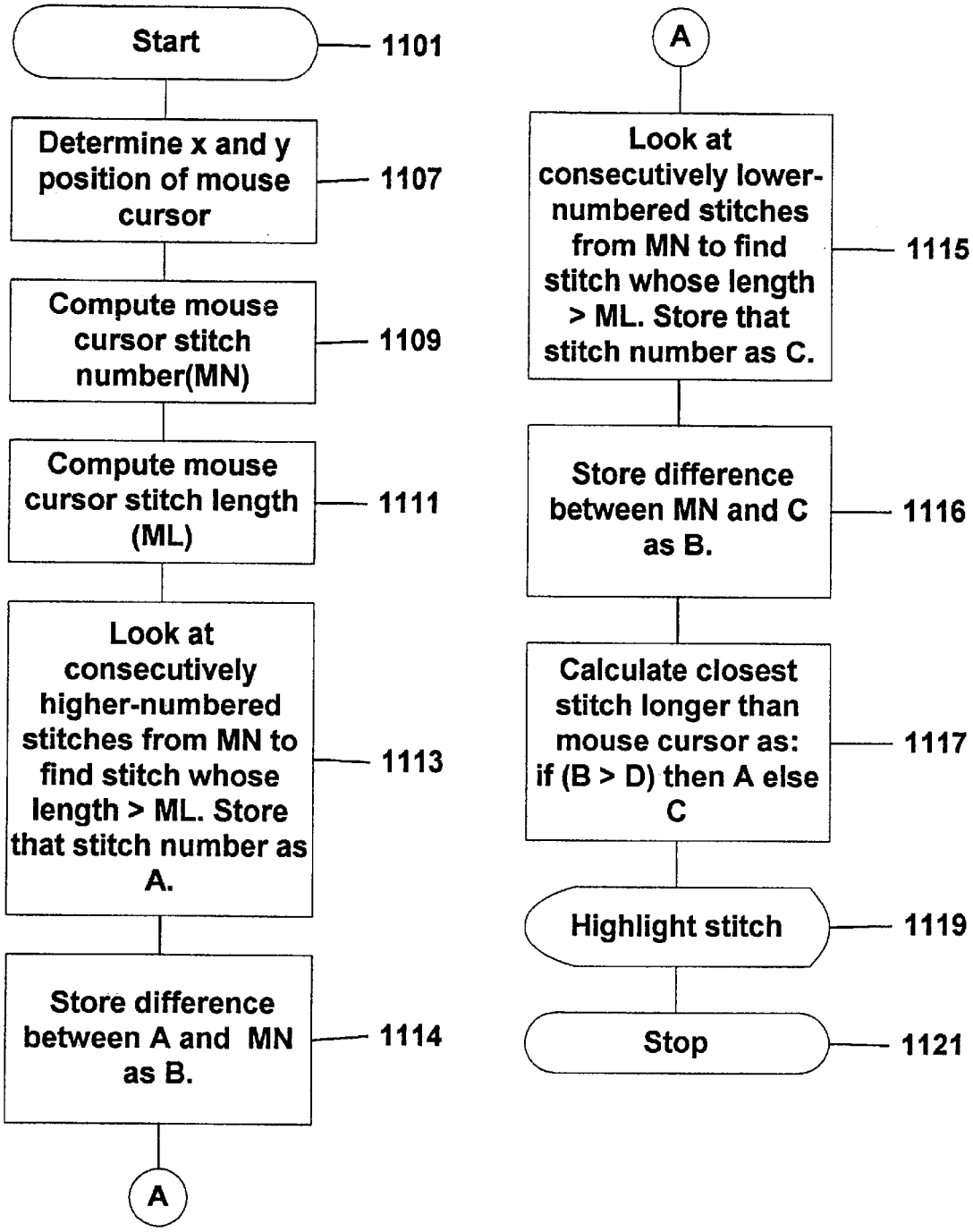
Figure 11D:
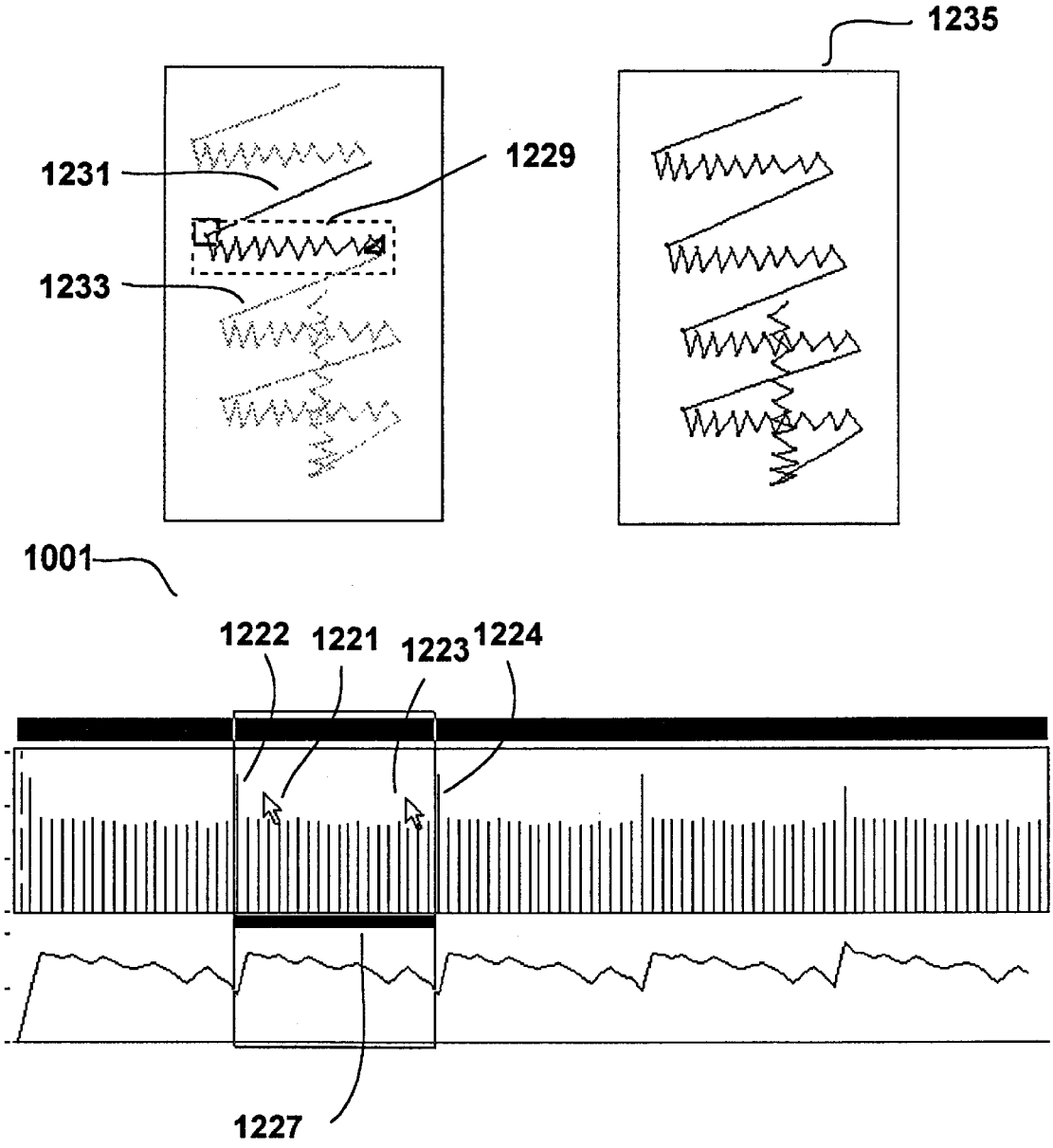

FIG. 11C is a simplified flow diagram 1100 of a method according to an embodiment of the present invention. This diagram is merely an example, which should not limit the scope of the claims herein. One of ordinary skill in the art would recognize many other variations, modifications, and alternatives. Depending on which particular chart or graph the mouse cursor is in the starting and ending stitch numbers may "snap" to the closest stitch with some property in order to facilitate the user in selecting an appropriate starting stitch and ending stitch. Referring to FIG. 11D, for example, the user positions a mouse cursor 1221 on a stitch length graph on a user display and depresses a mouse button. The method finds the closest stitch 1222 whose height in the stitch length graph rises above the y position of the mouse cursor. Here, the long stitch 1222 is highlighted. Details of this method are described below.

When the mouse cursor is in the stitch length chart, the y position of the mouse cursor is translated to a stitch length (mouse cursor stitch length) (step 1111), by a method that assumes a vertical bar in the chart representing a stitch extends up to the y position of the mouse, and computes what would be the length of that stitch.

Next, the method identifies a stitch (i.e., long stitch) that exceeds the mouse cursor stitch length, looking at higher-numbered stitches in the positive x-direction. Referring to FIG. 11D, for example, the closest stitch to the mouse cursor 1221 longer than the mouse cursor stitch length looking at higher-numbered stitches on the x-axis is stitch 1224. The method stores the stitch number of long stitch 1224 as "A". A difference between "A" and the x-location of the mouse cursor 1221 is stored as "B," which represents the span of stitches from the mouse cursor 1221 to long stitch 1224 in number of stitches.

Next, the method identifies a stitch (i.e., long stitch) that exceeds the mouse cursor stitch length, looking at lower-numbered stitches in the negative x-direction. Referring to FIG. 11D, again, the closest stitch to the mouse cursor 1221 longer than the mouse cursor stitch length looking at lower-numbered stitches on the x-axis is stitch 1222. The method stores the stitch number of long stitch 1222 as "C". A difference between "C" and the x-location of the mouse cursor 1221 is stored as "D," which represents the span of stitches from the mouse cursor 1221 to long stitch 1222 in number of stitches.

The method then determines which long stitch, 1222 or 1244, is closest spatially to the mouse cursor 1221. Here, the method determines the closest stitch according to the following relationship:

If B>D select A, otherwise select C.

Once the above calculation has been made, step 1117, the method highlights the closest long stitch, which is stitch 1222 in the present example, and uses the stitch number of long stitch 1222 as the starting stitch number.

As the user drags the mouse cursor thought the stitch length graph and finally releases the mouse button, steps 1107 through 1119 are repeated in order to calculate an ending stitch number. For example FIG. 11D shows the mouse cursor 1223 when the mouse button is released. The method calculates long stitch 1124 as the closest stitch longer than the mouse cursor stitch length, highlights long stitch 1124, and uses the stitch number of long stitch 1124 as the ending stitch number. This method then selects the stitches and the element 1227 that the stitches comprise between the two long stitches 1222 and 1224. The corresponding stitches are highlighted both in the stitches in time graph and in the stitches in space graph 1229. As shown, long stitch 1222 corresponds to long stitch 1231. Long stitch 1224 corresponds to long stitch 1233. Element 1227 corresponds to element 1229.

Practically, the mouse cursor stitch length is used to "snap" both the starting and ending stitch number to the closest-numbered stitch that is at least a long as the mouse cursor stitch length. This feature provides an easy way to select a block of stitches between any two long stitches. In a specific embodiment, the block of stitches may have the same color as adjacent stitches, which would make the selection of stitches very difficult to select since the long stitches may be difficult to see using conventional techniques. Since individual figures of a design are often delimited by long stitches, snapping the mouse to long stitches in the stitch length graph can often be used to select an individual figure of a design.

Once the desired element is selected, the present method can perform a manipulation on the selected element. The manipulation changes a characteristic of the selected or highlighted region. The manipulation can include a color change, a movement (from one location to another), a geometrical transformation, a deletion of the stitches or insertion of the stitches into another design, a change in when the stitches are sewn in relation to other stitches in the design, and others. The transformation can include, among others, translational movement, rotational movement, scaling, stretching, skewing, flipping, or any combination of these for the selected element. Once the desired manipulation has been performed, the method can stop. Other steps can also be performed, depending upon the application.

Figure 11E:
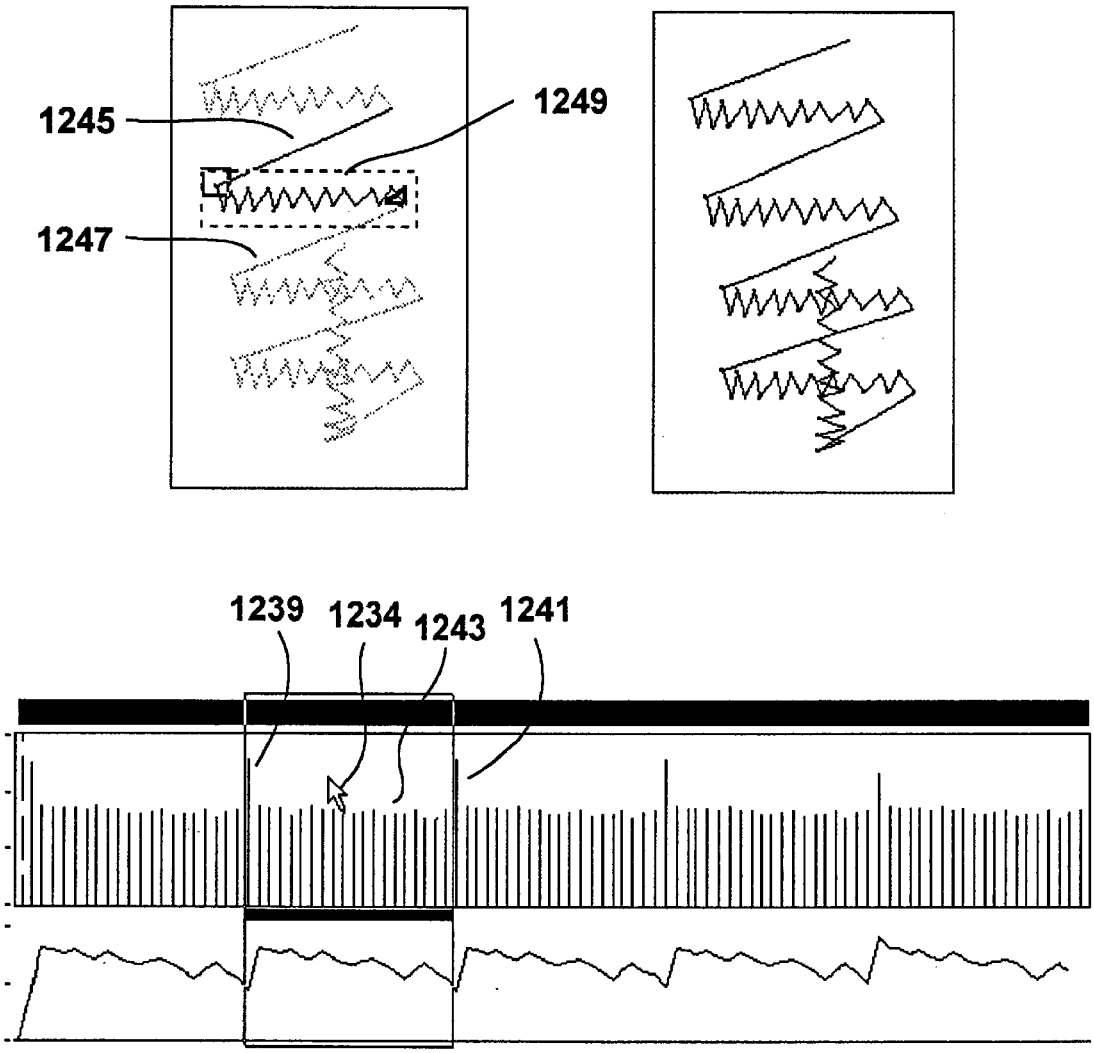

In an alternative embodiment, the present method selects an element in a complex embroidery design, such as the one in FIG. 11E. This Fig. is merely an example, which should not limit the scope of the claims herein. One of ordinary skill in the art would recognize many other variations, modifications, and alternatives. Here, the method allows a user to position a cursor 1234 in a stitch length graph. The cursor is positioned above a y-height run of consecutive stitches 1243, but still below two longer stitches 1239 and 1241. By placing the cursor at this position, and selecting it (by double-clicking in the present embodiment), the present method selects and highlights the region between the long stitches in the stitches in time graph. This region corresponds to region 1249, which is bordered by first stitch 1245 and last stitch 1247 in the stitches in space graph.

Accordingly, the present method can select a specific element, which is defined between stitches 1245 and 1247 in the stitches in space graph by selecting the corresponding portion of the stitches in time graph. Once the selection has been made, present method can perform a manipulation on the selected element. The manipulation changes a characteristic of the selected or highlighted region. The manipulation can include a color change, a movement (from one location to another), a geometrical transformation, and other change such as texture change. The transformation can include, among others, translational movement, rotational movement, scaling, stretching, skewing, flipping, or any combination of these for the selected element. Once the desired manipulation has been performed, the method can stop. Other steps can also be performed, depending upon the application.

Figure 11F:
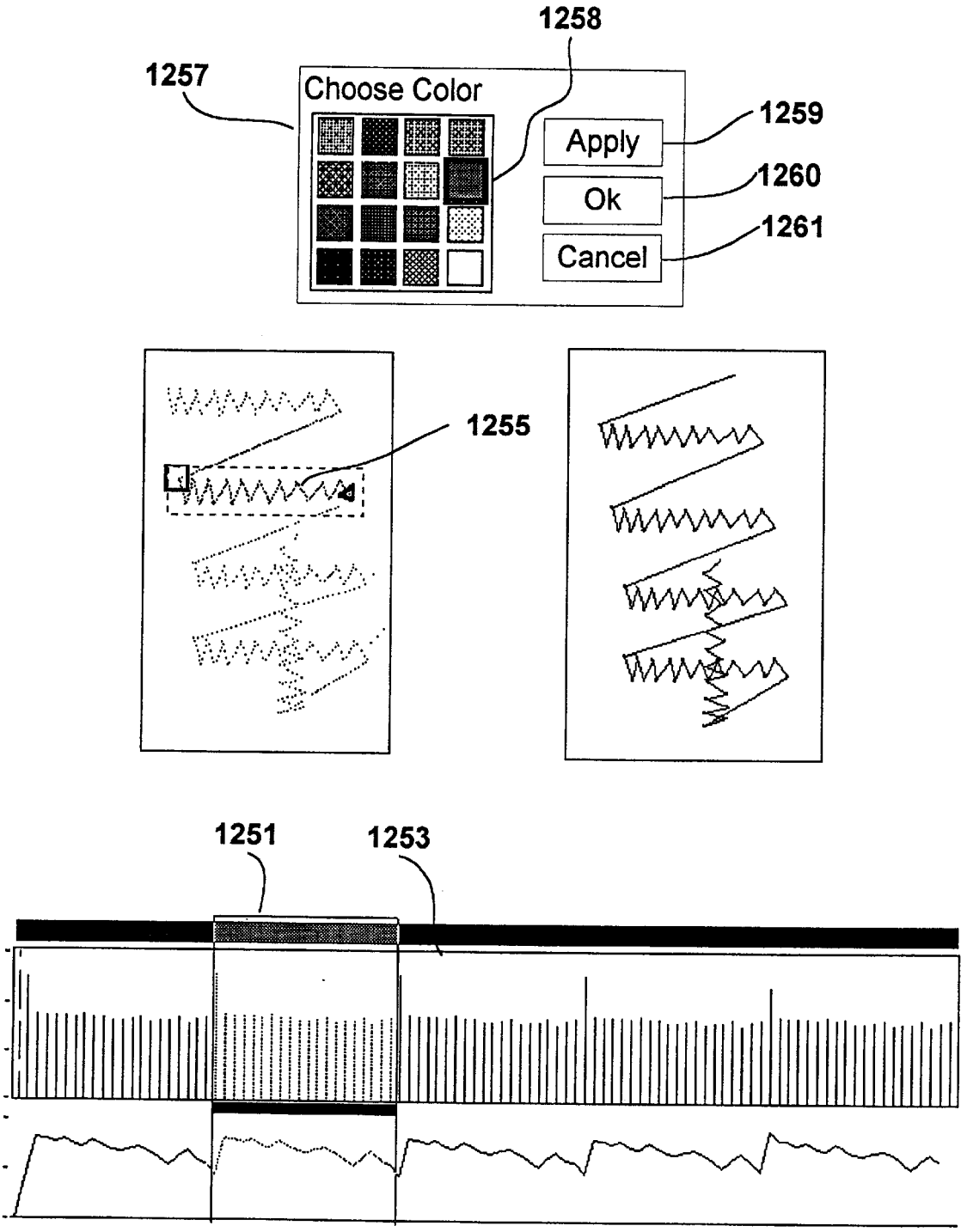

As merely an example, a manipulation for changing the color of a selected region is provided by the user display of FIG. 11F. This FIG. is merely an example, which should not limit the scope of the claims. One of ordinary skill in the art would recognize many other variations, modifications, and alternatives. Here, the method first selects a region 1251 of the embroidery design. The method can select the region using any of the techniques described above as well as others. In a specific embodiment, the method selects a region by dragging a cursor between two long stitches in the stitch length graph 1253, which highlights 1255 a corresponding region in the stitches in space graph.

To change the color of the selected region, the user selects a button on a tool bar, which displays a color pallet 1257. The color pallet shows a plurality of colors, where each different color is in a square or thumbnail. In the present example, the user selects color 1258 by clicking in square 1258 with the mouse and then selecting the "APPLY" 1259 indication, which changes the color of the selected stitches in both the stitches in time graphs and the stitches in space graph. The present method also can insert a color change event or events (e.g., thread change data) into the stitch data between, for example, groups of data that represent different elements. Here, the method inserts a color change event at the beginning of an element and an element of an element of a design. The element is any suitable computer code(s) that facilitates the color change process, e.g., stop machine for color change. The present method is useful for adding such color change event between a first group of stitches and a second group of stitches (defining different elements) that are of the same color before, for example, a color change operation. To finalize the application of the color, the user selects the "OK" indication. Alternatively, the user can as select the "CANCEL" 1261 indication. From this user display, the user can select other regions and colors depending upon the application.

An alternative method according to the present invention for identifying a starting stitch number and an ending stitch number in a region of a design may be briefly outlined as follows:

(1) Select a region of stitches by a user device (on a computer) in a stitch color chart for an embroidery design according to the present invention:

(2) Determine an x position of mouse cursor along stitch number axis of the graph, which can run along a horizontal axis;

(3) Compute stitch number from the x-position as the mouse cursor stitch number;

(6) Search for higher-numbered stitches and lower-numbered stitches to identify the closest stitch to the mouse cursor stitch number which has a different color than the color of the stitch corresponding to the mouse cursor stitch number.

(10) Highlight the starting stitch based upon step (8);

(11) Drag mouse to second location;

(12) Repeat steps (3) to (8) above as the mouse is being dragged to the second location;

(13) Select the second location with the mouse;

(14) Repeat steps (3) to (8) to highlight the ending stitch;

(15) Highlight the stitches between the starting stitch number and the ending stitch number in the stitch length graph and/or the stitches in space graph to define an element or a portion of an element or portions of more than one element in the design;

(16) Perform a manipulation (e.g., color change, movement, geometrical transformation) for the selected element or the portion of the element in the design;

(17) Display manipulated element with modified design in space in time graph; and

(18) Perform other steps, if desired.

This method has the practical effect of "snapping" the mouse cursor to stitches at a thread color change, and allows easy selection of a block of stitches comprising one entire thread color, or several adjacent thread colors. The present method can be combined with any of the other techniques described above, as well as others.

Although the above invention has been described using a specific sequence of steps. It would be recognized that other variations can exist. For example, the sequence of steps can be changed in order. Additionally, a step in the sequence of steps can be removed. Alternatively, steps in the sequence can be combined. Furthermore, an additional step or steps can be inserted. These and other combinations will be apparent to those of ordinary skill in the art. Although the above has been described in terms of software and hardware, it would be appreciated that many other variations, modifications, and alternatives exist.

While the above is a full description of the specific embodiments, various modifications, alternative constructions and equivalents may be used. Therefore, the above description and illustrations should not be taken as limiting the scope of the present invention which is defined by the appended claims.

What is claimed is:

1. A graphical user interface device for providing displays of an embroidery design, the interface comprising:

a display couple to a microprocessing device and a memory device;

an electronic representation of a stitch on a first axis of the display, the electronic representation of the stitch being selected from a stitch number, a time, or a combination of a stitch number and a stitch time, the electronic representation being stored in the memory device; and a property of the stitch in electronic form on a second axis of the display, where the second axis intersects the first axis to illustrate the property as a function of the electronic representation, the property of the stitch being stored in the memory of the device.

2. The device of claim 1 wherein the property of the stitch is color.

3. The device of claim 1 wherein the first axis represents time and the distance between the representation of successive stitches is proportional to the amount of time taken to sew the stitch.

4. The device of claim 2 wherein each spatial feature has an area that is proportional to a number of stitches for the color.

5. The device of claim 1 wherein the electronic representation comprises a component bar chart.

6. The device of claim 1 wherein the electronic representation comprises a histogram.

7. The device of claim 6 wherein the histogram is a bar representation.

8. The device of claim 7 wherein the bar representation comprises a plurality of bars, the height of each bar being proportional to the log of the length of the stitch.

9. The device of claim 7 wherein the bar representation comprises a plurality of bars, the height of each bar being proportional to the length of the stitch.

10. An embroidery method comprising displaying embroidery stitch data; wherein the embroidery stitch data comprises one or more charts of a property of a stitch plotted as a function of stitch number or time, the stitch data being stored in wherein the chart is a bar graph or histogram of stitch length plotted as a function of stitch number or time.

11. An embroidery method comprising displaying embroidery stitch data; wherein the embroidery stitch data comprises one or more charts of a property of a stitch plotted as a function of stitch number or time, the stitch data being stored in a computer readable memory device, wherein the chart is a line graph of stitch angle plotted as a function of stitch number or time.

12. An embroidery method comprising displaying embroidery stitch data; wherein the embroidery stitch data comprises one or more charts of a property of a stitch plotted as a function of stitch number or time, the stitch data being stored in a computer readable memory device, wherein the chart is a component bar chart of stitch color plotted as a function of stitch number or time, the length of each component bar being proportional to the number of stitches for the color.

13. A method for selecting stitches in a complex embroidery design, the complex embroidery design being displayed on a user device coupled to a computing device, the method comprising:

providing a representation of a plurality of stitches in one or more time graphs on a user display; and selecting a portion of the plurality of stitches by choosing a starting stitch number and an ending stitch number from the time graphs, the selected portion comprising the stitches between the starting stitch number and ending stitch number.

14. The method of claim 13 wherein the plurality of stitches is contiguous.

15. The method of claim 13 wherein the selecting step further comprises selecting a plurality of portions of the plurality of stitches, the portions being non-contiguous.

16. The method of claim 13 wherein a cursor is used to choose the starting stitch and ending stitch from the time graphs.

17. The method of claim 13 wherein the selected stitches comprise an element of a complex embroidery design composed of a plurality of elements.

18. The method of claim 13 wherein at least one of the starting and ending stitch is changed to the closest stitch in stitch number that has a minimum stitch length input by the operator.

19. The device of claim 13 wherein the starting and/or ending stitch is changed to the closest stitch in stitch number that has a different thread color than its preceding or succeeding stitch.

20. The device of claim 13 wherein the embroidery design is originally produced by another embroidery creating data processing system.

* * * * *